US007252052B2

(12) United States Patent
Groehl et al.

(10) Patent No.: US 7,252,052 B2
(45) Date of Patent: Aug. 7, 2007

(54) GAS-FIRED HEATING APPARATUS

(75) Inventors: Alexander Groehl, Dolgesheim (DE); Robert Hirsch, Ingelheim (DE); Klaas W. Roelfsema, Gasselternijveenschemond (NL)

(73) Assignee: Ceramat, S.Coop., Asteasu (Gipuzkoa) (ES)

( * ) Notice: Subject to any disclaimer, the term of this patent is extended or adjusted under 35 U.S.C. 154(b) by 247 days.

(21) Appl. No.: 10/978,571

(22) Filed: Nov. 1, 2004

(65) Prior Publication Data

US 2005/0175951 A1 Aug. 11, 2005

(30) Foreign Application Priority Data

Feb. 7, 2004 (DE) ..... 10 2004 006 091

(51) Int. Cl.
*F23C 5/00* (2006.01)

(52) U.S. Cl. ..... 122/17.1; 431/114

(58) Field of Classification Search ..... 122/13.01, 122/17.1; 431/114

See application file for complete search history.

(56) References Cited

U.S. PATENT DOCUMENTS 4,953,510 A 9/1990 Akkala et al.
5,062,790 A * 11/1991 Loberger et al. ..... 431/114
5,203,689 A * 4/1993 Duggan et al. ..... 431/114
5,816,793 A * 10/1998 Nakamoto et al. ..... 431/114
5,875,739 A 3/1999 Joyce
6,435,862 B1 * 8/2002 Fioriti et al. ..... 431/354
6,491,514 B1 * 12/2002 Hamad et al. ..... 431/114
2003/0111023 A1 6/2003 Carbone et al.

FOREIGN PATENT DOCUMENTS

| | | |
|---|---|---|
| AT | 251 242 | 12/1966 |
| DE | 22 63 471 | 4/1975 |
| DE | 38 42 842 A1 | 6/1990 |
| DE | 102 15 688 A1 | 11/2003 |
| GB | 1 033 345 | 6/1966 |

* cited by examiner

*Primary Examiner*—Gregory Wilson
(74) *Attorney, Agent, or Firm*—Michael J. Striker

(57) ABSTRACT

The gas-fired heater, especially a water heater, has an atmospheric gas burner (5) arranged within a nearly or completely closed combustion chamber (2) and associated with a premixing gas/air supply system (8) with a fuel gas feed nozzle (10). In order to avoid oscillations, which lead to sound waves and combustion instabilities, an oscillation-damping air supply chamber (11, 11', 11") is connected to the entrance (8*a*) of the gas/air supply system (8) for combustion air, within which the fuel gas feed nozzle is arranged. The air supply chamber (11, 11', 11") is provided with at least one air entrance (12, 12', 12"). The air supply chamber can be box-like, duct-like embracing or extending around the combustion chamber or it can be a pipe with different diameter pipe sections.

14 Claims, 4 Drawing Sheets

GAS-FIRED HEATING APPARATUS

BACKGROUND OF THE INVENTION

1. Field of the Invention

The present invention relates to a gas-fired heating apparatus or heater comprising at least one atmospheric gas burner, which is arranged within a partially or completely closed combustion chamber and which is associated with a complete premixing gas/air supply system with a fuel gas feed nozzle, whose inlets for fuel gas and combustion air are arranged on the heater outside of the combustion chamber.

2. Related Art

This sort of gas-fired heating apparatus, to which the invention relates, is typically a gas-fired hot water heater or a gas-fired heating apparatus, like those used for industrial heating units or household fireplaces.

Gas-fired hot water heaters are in use in many different embodiments and power stages in different applications both in the private and industrial sectors.

This sort of gas-fired not water heater prepares hot water for industrial use or for household or industrial applications.

The so-called "water heater" marketed in the USA is a special embodiment of this sort of gas-fired hot water heater, which produces water for showers or the like in the workplace or other places. For example, a "water heater" is described in U.S. Pat. No. 4,953,510, which comprises a water tank for storing the heated water. This water tank is combined with a device for heating water in the water heater. The device for heating the stored water comprises an open atmospheric gas burner. The hot exhaust gas including the combustion products from the gas burner acts on the bottom of the water tank and subsequently rises through an elongated exhaust flue, which extends through the center section of the water tank. In this type of water heater the hot gas flowing upward in the exhaust flue comes into contact with the interior surfaces of the exhaust pipe, while the water in the water tank is in contract with the outer surfaces of the pipe. While the combustion proceeds, the water within the water tank is heated by heat conduction through the wall of the exhaust flue. In this type of water heater normally a longitudinal separating wall is arranged within the exhaust pipe in order to improve the efficiency of the heat transfer through the wall of the exhaust pipe from the hot combustion gas to the water within the water tank. Further this sort of water heater can have a thermally activated valve, which stops the combustion at the gas burner, when the temperature of the water in the water tank reaches a predetermined temperature.

In order to reduce heat loss from the water heater both during the heating of the water and also after halting the combustion process, the outer surface of the water tank is usually covered with a thermal insulation material.

Increasingly strict legal regulations regarding avoiding accidents, especially when combustible vapors arrive in the open combustion region, and in regard to improvement of exhaust gas content, have led to developments in the water heater field, which provide a nearly completely closed combustion (burner) chamber, in which a premixing gas burner, a so-called pre-mix burner, is arranged.

This sort of water heater is described in U.S. Pat. No. 5,875,739. The structure and arrangement of the prior art pre-mix burner in the closed combustion chamber is shown in FIG. 4 of the present application, which is taken from the above-mentioned U.S. Patent. This figure is a cross-sectional view of a water heater with a water tank 1 and a nearly closed combustion chamber 2, to which an exhaust flue 3 is connected, which extends through the center of the water tank 1. The combustion chamber 2 and the water tank 1 are insulated from the surrounds by thermal insulation 4. An atmospheric pre-mix burner 5 is arranged in the combustion chamber 2, which comprises a mixing chamber 6 and a spherical burner mat 7. A Venturi 8 is connected to the mixing chamber 6, which extends through the thermal insulation 4 until at the outer surface of the water heater. A nozzle 10 for supplying the fuel gas is arranged within the outer opening of the Venturi. Primary air is drawn through the outer opening 9 while fuel gas flows into the Venturi 8, which is then mixed by turbulence with the fuel gas in the mixing chamber 6.

Another embodiment of a water heater with a complete premixing atmospheric gas burner is described in U.S. Patent Application 2003/0111 023 A1. This known gas burner 5 is constructed with a planar rectangular burner mat, as shown in FIG. 5 of the present application, which is taken from this U.S. Patent Application. This figure shows the mixing chamber 6 formed together with the Venturi 8. The Venturi 8 has an inlet 10' for fuel gas and the entrance opening 9 for primary air.

It has been shown that the pressure behavior in the combustion chambers of gas-fired heaters with atmospheric, complete premixing gas burners in a nearly completely closed combustion chamber produces resonances, which put the system into oscillation. These resonance oscillations have the following disadvantages:

- no stable or uniform combustion with reduced flue gas quality is possible,
- noticeable troublesome loud sound is produced,
- back fire of the flames through the combustion medium is possible, depending on the turbulence in the combustion chamber.

SUMMARY OF THE INVENTION

It is an object of the present invention to provide a gas-fire heating apparatus of the above-described kind, especially a hot water heater or an industrial or home heating unit, in which acoustic resonances are prevented, so that the associated gas burner system is noise-free and the combustion is stable.

This object and others, which will be made more apparent hereinafter, are attained in a gas-fired heating apparatus with at least one atmospheric gas burner, which is arranged within a nearly or completely closed combustion chamber and is associated with a complete premixing gas/air supply system with a fuel gas feed nozzle, whose inlets for fuel gas and combustion air are arranged on the heating apparatus outside of the combustion chamber.

According to the invention an oscillation-damping air supply chamber provided with at least one air inlet is connected to the entrance of the gas/air supply system for combustion air, within which the fuel gas feed is arranged.

This oscillation-damping air supply chamber is similar to the known acoustic resonator used for acoustic and noise analysis, which is also called a Helmholtz resonator. The oscillation-damping air supply chamber is constructed in regard to its volume and configuration, so that its resonance frequency is tuned to an acoustic wave and/or oscillation arising in the combustion chamber and is thus canceled or at least strongly attenuated by interference.

Because of that no resonance oscillation can oscillate in the combustion chamber, so that the gas burner system is noise-free and the combustion process taking place at the burner is stable.

Additional advantages are:

well-defined or steady air supply, no influence of gas input by the air movement, since the gas feed is within the chamber, guaranteeing that the combustion is not adversely affected, since the combustion air is well-defined or steady, an improvement of the combustion quality is established, and dust found at the bottom cannot be drawn in, since the combustion air supply can be guided upward.

Additional features and further embodiments of the invention are in the dependent claims and are described further in the following description.

The oscillation-damping supply chamber can have various shapes and configurations in different embodiments. In one embodiment the air supply chamber has a parallelepiped or box shape and its air inlet is arranged laterally or on at least one side thereof. In another embodiment the air supply chamber has a duct-shape, embraces an outer wall of the combustion chamber and extends around the wall on both sides of the entrance to the premixing gas/air supply system and the air supply chamber has air intake openings on opposite ends thereof. In an additional embodiment the air supply chamber is a pipe, in fact it can be a pipe comprising a plurality of pipe sections of different diameters arranged to conserve space.

The oscillation-damping air supply chamber can be a separate component, which is connected with the premixing gas/air supply system and/or a wall of the combustion chamber or a door of the combustion chamber. On the other hand, it can also be in one piece with the premixing gas/air supply system.

BRIEF DESCRIPTION OF THE DRAWING

The objects, features and advantages of the invention will now be illustrated in more detail with the aid of the following description of the preferred embodiments, with reference to the accompanying figures in which.

DETAILED DESCRIPTION OF THE INVENTION

Figure 1A:
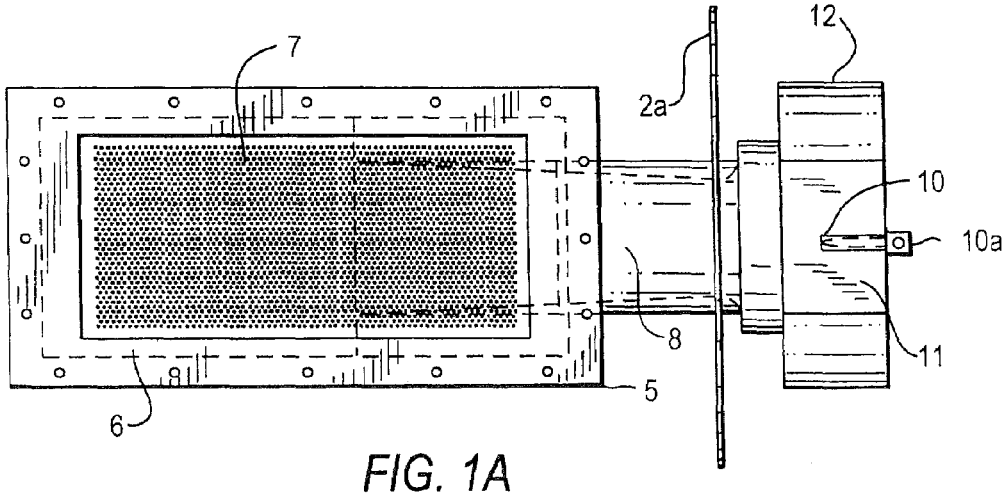
FIG. 1A is a top plan view of a first parallelpiped-shaped embodiment of an oscillation-damping air supply chamber according to the invention shown connected with an atmospheric gas burner and complete premixing Venturi gas/air supply system for a gas-fired heating apparatus, which are to be arranged within a nearly completely closed combustion chamber.
Figure 1B:
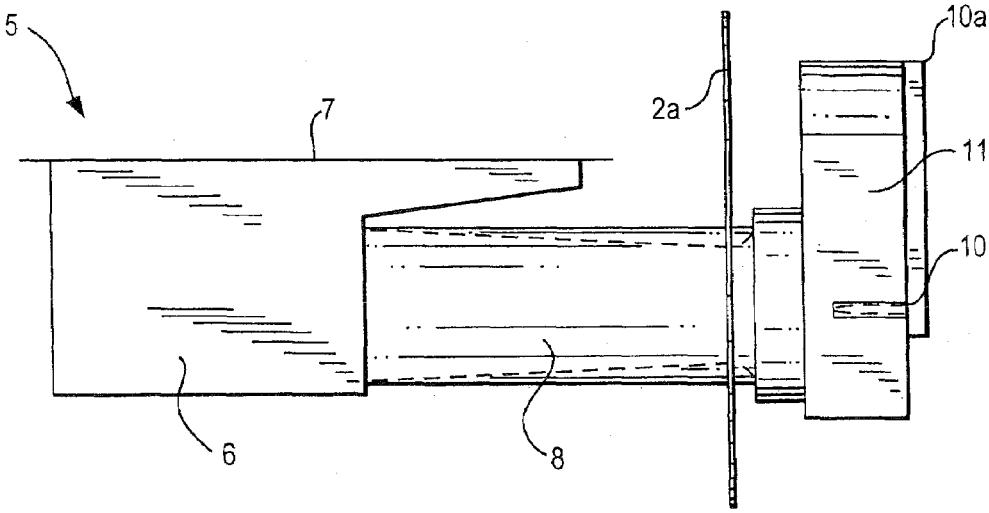
FIG. 1B is a side view of the first embodiment of the apparatus shown in FIG. 1A.

FIGS. 1A and 1B show different views of a first embodiment of an oscillation-damping air supply chamber 11 according to the invention, shown connected with an atmospheric gas burner 5. The gas burner 5 is constructed in a manner similar to the prior art gas burner shown in FIG. 5. Atmospheric gas burners are usually understood to be those gas burners, which operate without the assistance of a blower. This gas burner 5 is arranged within a nearly or completely closed combustion chamber 2 of a heater, for example a water heater like that shown in FIG. 4. In FIGS. 1A and 1B only its outer wall 2*a* is shown to simplify the illustration. For example, the gas burner 5 can also be mounted in a door in the wall 2*a*.

The gas burner 5 has a planar rectangular burner mat or burner plate 7, which is formed by conventional components, e.g. by a burner mat made from ceramic fibers, which is marketed under the trademark CERAMAT®. The burner mat can be circular, oval or a free form. Also it is possible that it can comprise metal fibers or ceramic stones.

The burner mat/plate 7 covers a mixing chamber 6. A Venturi 8 is connected to the mixing chamber 6 or formed together with it. The intake of the fuel gas occurs by means of an intake duct 10*a*, which conducts the fuel gas into the Venturi 8. The lower end of the intake duct 10*a* is connected to a fuel gas feed nozzle 10, which feeds the fuel gas into the Venturi 8. A parallelpiped-shaped or box-shaped air supply chamber 11, which has a lateral or side air entrance 12 for combustion air, is connected to the entrance of the Venturi 8. The fuel gas feed nozzle 10 opens into the air supply chamber 11. This air supply chamber 11 has a predetermined definite volume, typically at least 2.5 liter, such that a sound wave or noise arising in the combustion chamber due to resonance is damped or attenuated. Thus no disturbing acoustic oscillations arise and the combustion remains stable. The volume can also be smaller according to the particular application.

This sort of structure is also called a Helmholz resonator in acoustics.

The oscillation-damping air supply chamber 11 in the embodiment of FIGS. 1A and 1B is parallelepiped-shaped or box-shaped. However the oscillation-damping air supply chamber connected to the Venturi 8 can have other shapes according to the invention. In the embodiment shown in FIG. 2 the duct-shaped air supply chamber 11' partially extends around and embraces the combustion chamber 2 or outer wall 2*a*. It has air intake openings 12' on both ends and a rectangular cross-section. This air supply chamber 11' is connected in its center to the entrance 8*a* of the Venturi 8. The fuel gas nozzle 10 opens into this connecting region.

Figure 3:
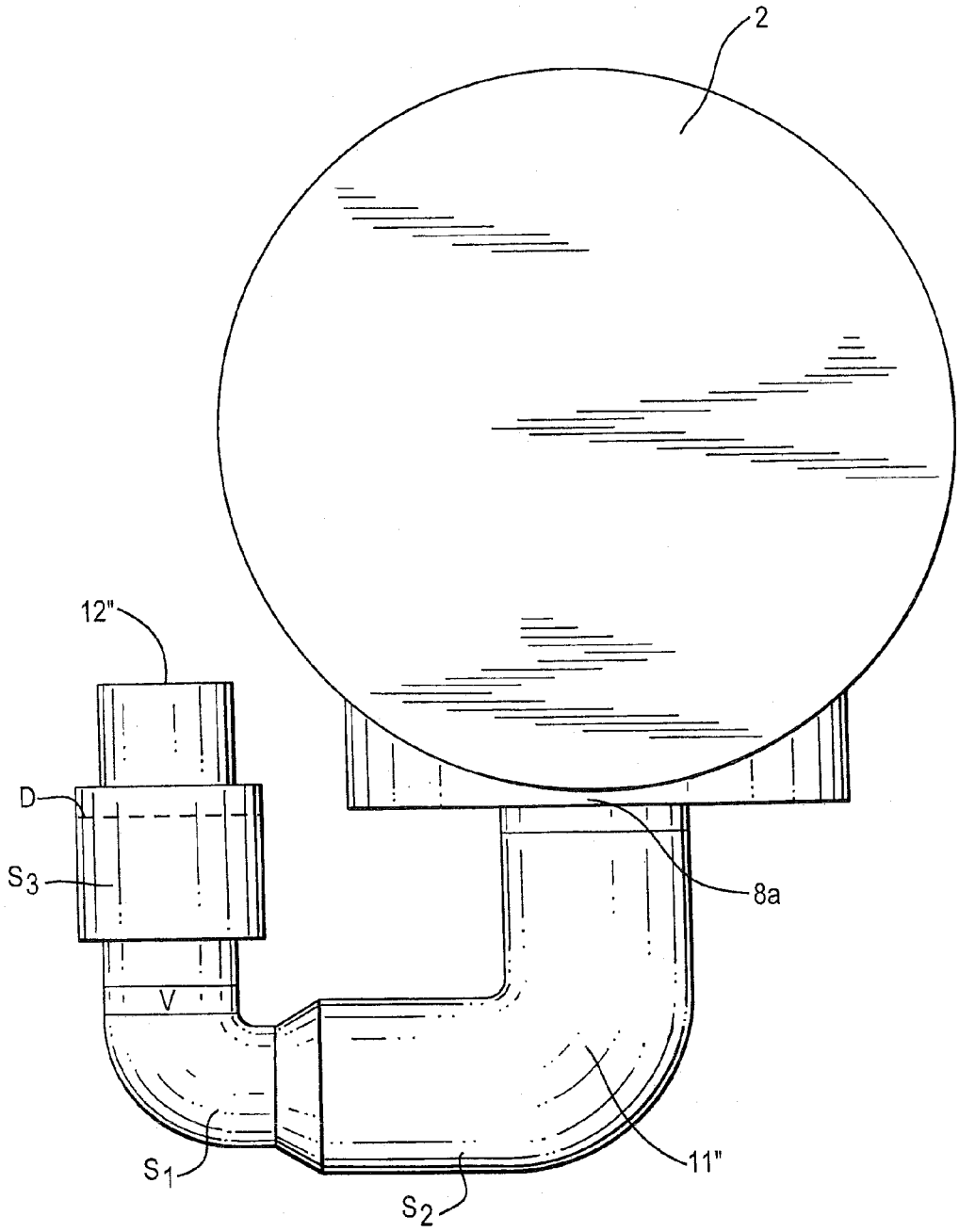
FIG. 3 is a plan view of a third pipe-shaped embodiment of an oscillation-damping air supply chamber according to the invention and a connected combustion chamber.

In the additional embodiment shown in FIG. 3 the air supply chamber 11" with the air inlet 12" is pipe-shaped with different pipe sections $S_1$, $S_2$, $S_3$, . . . . The pipe sections have different diameters and are arranged in order to provide a Helmholz resonator in the smallest possible space and to provide conditions for compensation of resonance oscillations in the combustion chamber 2.

Additional shapes or configurations for the air supply chamber are conceivable. The shape may be a free form if the conditions for damping resonance are fulfilled by its volume and shape or configuration.

The air supply chamber can be a separate component, which is connected in a suitable manner with the Venturi and/or the combustion chamber and/or the combustion chamber door, for example by screwing, welding, gluing, riveting, etc.

The air supply chamber can also be constructed together with the Venturi as a one-piece component. Finally the air supply chamber can be a component of the combustion chamber, e.g. it can be integrated in the insulation of the combustion chamber in water preparation including the water heater.

The materials used for the air supply chamber can be: aluminum, stainless steel, plastic, i.e. all materials, which permit simply manufacturing steps, such as deep drawing, welding, pressing, molding and the like.

According to further embodiments of the invention the fuel gas supply, i.e. the gas feed nozzle and the associated gas intake duct 10*a*, could be integrated in the oscillation-damping air intake chamber.

The respective air supply chamber can also have more than two air intake openings. It can have shutoff valves, which cause shut off of the apparatus under certain conditions, e.g. if it is very dirty or clogged by dust/dirt/oil. Adjustable valves V (FIG. 3) can be provided, which make it possible to adjust the air supply to different operating ranges of the gas burner or different types of gas.

The respective air supply chamber can have an exchangeable or easily cleanable dirt catcher D, especially in the form of a screen, which prevent dust/dirt/oil from reaching the burner.

In the embodiments shown in the drawing the Venturi pipe 8 is formed as a mixing pipe. Also other known configurations, especially mixing pipes, can be provided as mixing means.

Figure 2:
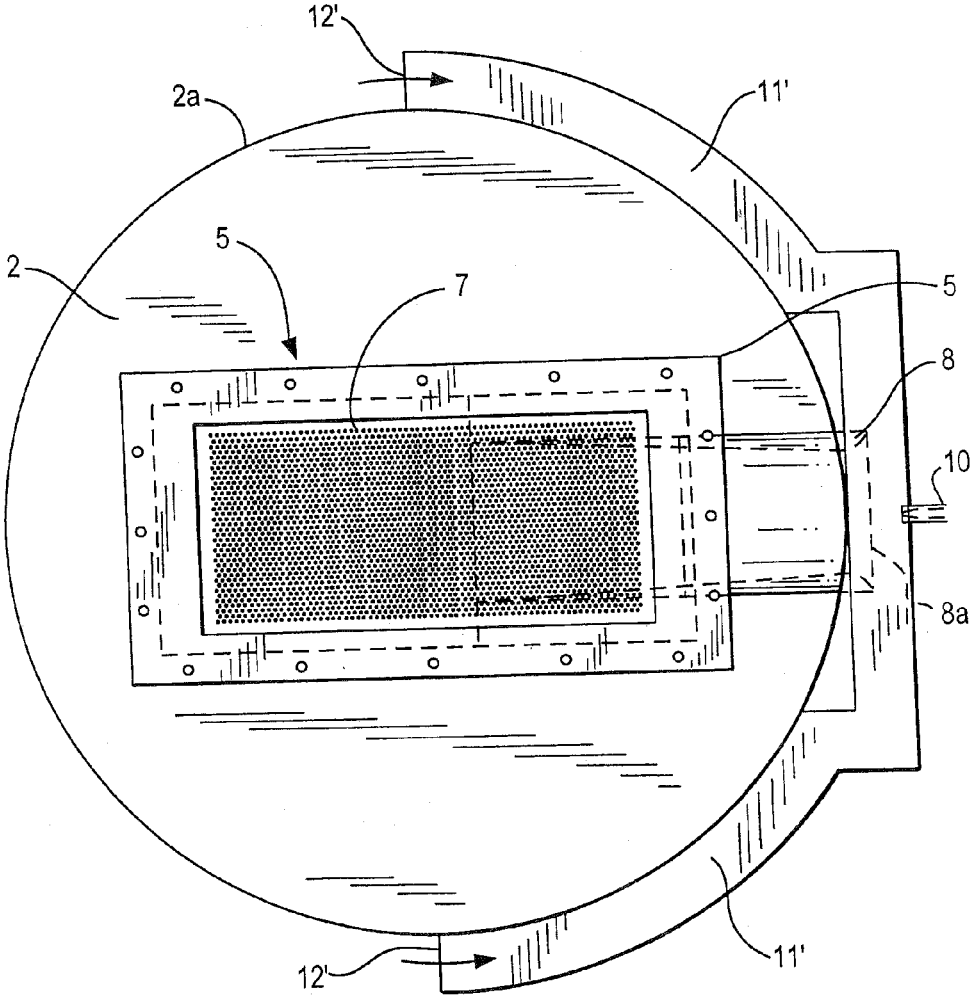
FIG. 2 is a plan view of second partially ring-shaped embodiment of an air supply chamber according to the invention shown connected with a gas burner.
Figure 5:
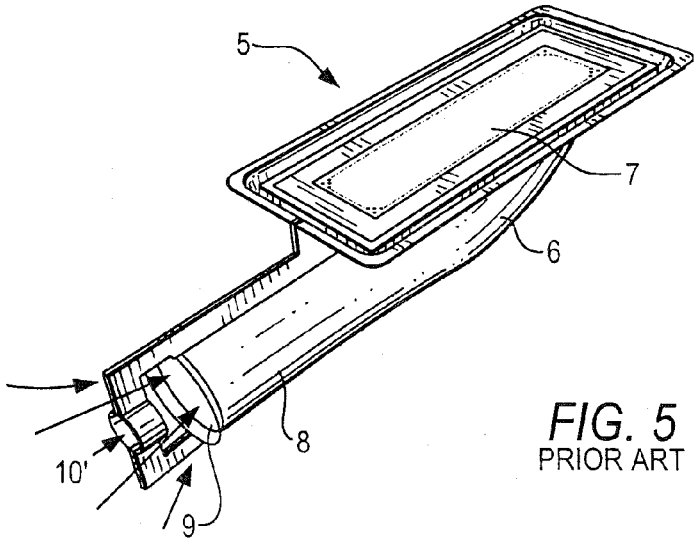
FIG. 5 PRIOR ART
FIG. 5 is a perspective view of a complete premixing gas burner of the prior art with a planar burner surface.

It is understandable that other complete premixing gas burners can be used instead of the complete premixing gas burner of the type shown in FIG. 5 in the apparatus shown in FIGS. 1 to 3.

Figure 4:
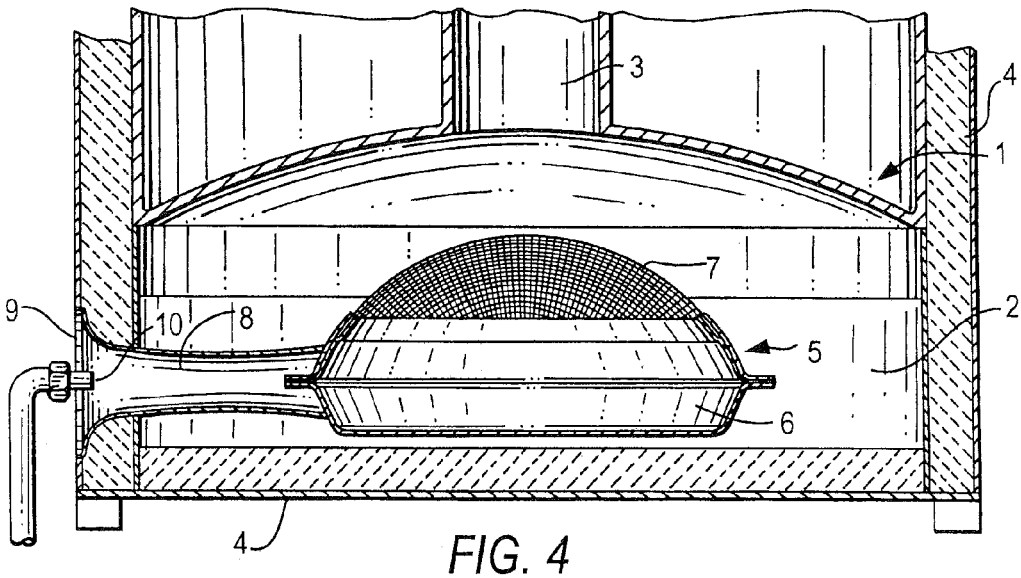
FIG. 4 PRIOR ART
FIG. 4 is a longitudinal cutaway cross-sectional view of a prior art heating apparatus including a gas burner with a spherical burner surface.

As is apparent from the above, a respective heating apparatus according to the invention is obtained in general by replacing the gas burner and gas/air supply system of the prior art shown in FIG. 4 with a gas burner, gas/air supply system of the invention, such as those shown in FIGS. 1 to 3, including the oscillation damping gas supply chamber.

The disclosure in German Patent Application 10 2004 006 091.6-13 of Feb. 7, 2004 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in an improved gas-fired water heater, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims.

We claim:

1. A gas-fired heating apparatus comprising a nearly or completely closed combustion chamber (2);

at least one atmospheric gas burner (5) arranged inside of said nearly or completely closed combustion chamber (2);

a complete premixing gas/air supply system (8) associated with said at least one atmospheric gas burner to supply fuel gas and combustion air to said at least one atmospheric gas burner, said complete premixing gas/air supply system (8) having an entrance (8*a*);

an oscillation-damping air supply chamber (11, 11', 11") connected to said entrance (8*a*) of the premixing gas/air supply system (8); and a fuel gas feed nozzle (10) arranged within said air supply chamber (11, 11', 11") and at said entrance (8*a*) to said complete premixing gas/air supply system (8), wherein said fuel gas feed nozzle (10) is in communication with an inlet for said fuel gas arranged outside of said combustion chamber; wherein said oscillation-damping air supply chamber has a duct shape, said air supply chamber embraces a wall (2*a*) of said combustion chamber (2) and extends partly around said wall (2*a*) on both sides of said entrance (8*a*) to said premixing gas/air supply system (8), said oscillation-damping air supply chamber (11') has respective air intake openings (12') on opposite ends thereof, and said respective air intake openings (12') are arranged outside of said combustion chamber (2).

2. A gas-fired heating apparatus comprising a nearly or completely closed combustion chamber (2);

at least one atmospheric gas burner (5) arranged within said nearly or completely closed combustion chamber (2);

a complete premixing gas/air supply system (8) associated with said at least one atmospheric gas burner to supply fuel gas and said combustion air to said at least one atmospheric gas burner, said complete premixing gas/air supply system (8) having an entrance (8*a*);

an oscillation-damping air supply chamber (11, 11', 11") connected to said entrance (8*a*) of the premixing gas/air supply system (8), said oscillation-damping air supply chamber (11, 11', 11") having at least one air inlet (12, 12', 12") for admitting said combustion air and said at least one air inlet (12, 12', 12") being arranged outside of said combustion chamber (2);

a fuel gas feed nozzle (10) arranged inside of said air supply chamber (11, 11', 11") and at said entrance (8*a*) to said complete premixing gas/air supply system (8), wherein said fuel gas feed nozzle (1) is in communication with an inlet for said fuel gas arranged outside of said combustion chamber; and not including a blower that assists in supplying said combustion air to said at least one atmospheric gas burner in operation;

wherein said oscillation-damping air supply chamber (11, 11', 11") has a predetermined interior volume adjusted to damp acoustic oscillations in said combustion chamber (2).

3. The gas-fired heating apparatus as defined in claim 2, wherein said interior volume is about 2.5 liters.

4. The gas-fired heating apparatus as defined in claim 2, wherein said oscillation-damping air supply chamber has a parallelepiped shape or a box shape and said at least one air inlet of said oscillation-damping air supply chamber is arranged laterally or on at least one side of said air supply chamber.

5. The gas-fired heating apparatus as defined in claim 2, wherein said oscillation-damping air supply chamber is shaped like a pipe.

6. The gas-fired heating apparatus as defined in claim 5, wherein said air supply chamber comprises pipe sections of different diameters.

7. The gas-fired heating apparatus as defined in claim 2, wherein said air supply chamber (11, 11', 11") is in one piece with said premixing gas/air supply system (8).

8. The gas-fired heating apparatus as defined in claim 2, wherein said fuel gas feed nozzle (10) and an associated gas intake duct (10*a*) are integrated in said oscillation-damping air supply chamber.

9. The gas-fired heating apparatus as defined in claim 2, further comprising adjustable valves (V) mounted in the oscillation-damping air supply chamber.

10. The gas-fired heating apparatus as defined in claim 2, further comprising dirt catching means (D) arranged in the oscillation-damping air supply chamber.

11. The gas-fired heating apparatus as defined in claim 2, wherein said complete premixing gas/air supply system (8) comprises a Venturi.

12. The gas-fired heating apparatus as defined in claim 2, wherein said oscillation-damping air supply chamber (11, 11', 11") is made of aluminum or stainless steel.

13. A gas-fired water heater comprising a water tank (1) for storing heated water;

a closed or nearly closed combustion chamber (2) arranged underneath the water tank;

an exhaust flue (3) communicating with the combustion chamber (2) and extending centrally through the water tank (1);

at least one atmospheric gas burner (5) arranged within said nearly or completely closed combustion chamber (2) so as to operate without assistance of a blower that supplies combustion air;

a complete premixing gas/air supply system (8) associated with said at least one atmospheric gas burner to supply fuel gas and said combustion air to said at least one atmospheric gas burner, said complete premixing gas/air supply system (8) having an entrance (8*a*);

an oscillation-damping air supply chamber (11, 11', 11") connected to said entrance (8*a*) of the premixing gas/air supply system (8), said oscillation-damping air supply chamber (11, 11', 11") having at least one air inlet (12, 12', 12") for admitting said combustion air arranged outside of said combustion chamber (2); and a fuel gas feed nozzle (10) arranged inside of said air supply chamber (11, 11', 11") and at said entrance (8*a*) to said complete premixing gas/air supply system (8), wherein said fuel gas feed nozzle (1) is in communication with an inlet for said fuel gas arranged outside of said combustion chamber;

wherein said oscillation-damping air supply chamber (11, 11', 11") has a predetermined interior volume adjusted to damp acoustic oscillations in said combustion chamber (2).

14. The gas-fired water heater as defined in claim 13, wherein said oscillation-damping air supply chamber (11, 11', 11") is made of aluminum or stainless steel.

* * * * *